US007438519B2

(12) United States Patent
Torres-Reyes

(10) Patent No.: US 7,438,519 B2
(45) Date of Patent: Oct. 21, 2008

(54) SEALING SYSTEM FOR SLURRY PUMP

(75) Inventor: Jorge E. Torres-Reyes, Vitacura (CL)

(73) Assignee: John Crane Inc., Morton Grove, IL (US)

( * ) Notice: Subject to any disclaimer, the term of this patent is extended or adjusted under 35 U.S.C. 154(b) by 549 days.

(21) Appl. No.: 11/205,678

(22) Filed: Aug. 17, 2005

(65) Prior Publication Data

US 2006/0051198 A1 Mar. 9, 2006

Related U.S. Application Data

(60) Provisional application No. 60/607,542, filed on Sep. 7, 2004.

(51) Int. Cl.
*F04D 29/08* (2006.01)

(52) U.S. Cl. ..... 415/126; 415/230; 415/231

(58) Field of Classification Search ..... 415/126, 415/128, 142, 168.2, 229, 230, 231; 277/510, 277/511, 512, 516
See application file for complete search history.

(56) References Cited

U.S. PATENT DOCUMENTS

| | | | | |
|---|---|---|---|---|
| 2,433,589 | A * | 12/1947 | Adams | 415/47 |
| 3,469,529 | A | 9/1969 | Bashenow et al. | |
| 3,477,385 | A | 11/1969 | Tangeman et al. | |
| 3,506,375 | A | 4/1970 | Endress | |
| 3,574,478 | A | 4/1971 | Toth et al. | |
| 5,195,867 | A | 3/1993 | Stirling | |
| 5,306,124 | A | 4/1994 | Back | |
| 5,427,500 | A | 6/1995 | Hyll | |
| 5,529,315 | A | 6/1996 | Borrino et al. | |
| 5,609,342 | A | 3/1997 | Peterson et al. | |
| 5,609,468 | A * | 3/1997 | Burgess | 415/171.1 |
| 5,713,576 | A | 2/1998 | Wasser et al. | |
| 5,772,217 | A * | 6/1998 | Poll | 277/383 |
| 5,772,218 | A | 6/1998 | Burgess | |
| 5,938,206 | A | 8/1999 | Klosterman et al. | |
| 5,954,341 | A | 9/1999 | Ringer et al. | |
| 6,210,107 | B1 | 4/2001 | Volden et al. | |

(Continued)

FOREIGN PATENT DOCUMENTS

| | | |
|---|---|---|
| AU | 607950 | 9/1989 |

(Continued)

OTHER PUBLICATIONS

Illustration—TRL Series ASH Pump for Minerals Slurry.

(Continued)

*Primary Examiner*—Igor Kershteyn
(74) *Attorney, Agent, or Firm*—Leydig, Voit & Mayer, Ltd.

(57) ABSTRACT

An improved slurry pump sealing system that employs a mechanical seal assembly fixed for axial movement with a bearing housing that moves axially to adjust pump impeller clearance. The relative relationship between the seal components remains unchanged regardless of the axial position of the shaft, impeller, and bearing housing. A contraction assembly with interconnecting members contracts to accommodate the reduction of the distance between the pump casing and shaft bearing housing on adjustment of pump impeller-to-casing clearance. In one embodiment the contraction assembly is a telescoping arrangement. In other embodiments, bellows are employed.

78 Claims, 9 Drawing Sheets

U.S. PATENT DOCUMENTS

| | | | | |
|---|---|---|---|---|
| 6,371,488 | B1 | 4/2002 | Szymborski et al. | |
| 6,601,854 | B2 | 8/2003 | Auber | |
| 6,708,980 | B2 | 3/2004 | Takahashi | |
| 6,834,862 | B2 * | 12/2004 | Wilkinson | 277/510 |

FOREIGN PATENT DOCUMENTS

| | | | |
|---|---|---|---|
| CA | 2262849 | | 10/1999 |
| DE | 20316570 | U1 | 1/2004 |
| EP | 1318312 | | 6/2003 |
| FR | 2560335 | | 8/1985 |
| GB | 1208554 | | 10/1970 |
| GB | 2394257 | | 4/2004 |
| JP | 55069795 | | 5/1980 |
| JP | 1247795 | | 10/1989 |
| WO | WO 98/07990 | | 2/1998 |
| WO | WO 03-025401 | A1 | 3/2003 |
| WO | WO 2004/029489 | | 4/2004 |

OTHER PUBLICATIONS

Illustration—Typical Mineral Slurries Stuffing Box.
Illustration—API Plan—32 & Plan—54 for double seal.
Examiner's Report on Invention Patent Application, Chilean Patent Application No. 2231-05, Dated Aug. 31, 2005, referring to cited references.

* cited by examiner

SEALING SYSTEM FOR SLURRY PUMP

This application claims the benefits under Title 35 U.S.C. § 120 based on Provisional Application Serial No. 60/607,542 filed Sep. 7, 2004 the content of which is incorporated by reference herein.

BACKGROUND OF THE INVENTION

This invention relates generally to sealing systems and more specifically to a sealing system for slurry pumps.

A typical slurry pump arrangement is shown in FIG. 1. It includes a centrifugal pump 2, having a pump housing or casing 20, supported on a base or pedestal 3, an impeller 18, and a shaft 16. The shaft 16 is supported by bearings 4 within a bearing housing 5. It is rotatable on the bearings but is fixed against axial movement relative to the housing 5.

Shaft 16 includes a free end 17 adapted to be connected to a drive motor (not shown). The bearing housing 5 with bearings 4 and shaft 16 is slidable relative to base 3 toward and away from pump casing 20 on rails 6. Bearing housing 5 includes a depending tab or arm 7. Base 3 supports a threaded shaft 8 provided with adjustment nuts 9. The tab 8 includes a bore surrounding the threaded shaft. The nuts are positioned on either side of the tab and are used to adjust the axial position of the bearing housing 7 relative to the pump casing.

Because the slurry material pumped contains particulate matter it is very abrasive. There is significant wear on the inner surface of the impeller casing usually near the inlet to the impeller 18. In some slurry pumps, a liner material is used to protect the inner surfaces of the impeller casing. Such a liner is shown in FIG. 2 and is generally designated 22. The presence of such a liner is not a part of the invention which is equally applicable to pumps without liners.

Slurry pumps are designed to accommodate the wear associated with operation. As previously described, the impeller shaft 16 is supported in a bearing housing 5 that is axially adjustable relative to pedestal 3. As the liner 22 or the inner surface of a pump casing wears within the pump cavity, the pump efficiency decreases. The spacing of the impeller to the casing is reestablished by axial adjustment of the position of the bearing housing 5 and consequently the shaft 16 to move the impeller 18 toward the inner surface of the casing.

Sealing systems have been used on slurry pumps for many years. A typical prior art sealing system 10 for a slurry pump is shown in FIG. 2. The prior art sealing system 10 includes an outer housing or stuffing box 12. The inner cylindrical surface of the stuffing box 12 defines a cylindrical bore surface extending through the stuffing box 12. An impeller shaft 16, attached to an impeller 18, passes through the stuffing box bore. The impeller 18 is situated within an impeller casing 20 with a casing liner 22 lining the inner surface of the casing 20. The stuffing box 12 is attached to the impeller casing 20. The liner 22 may be elastomeric or may not exist. It is, however, a common element in a slurry pump.

A slip-fit hardened shaft sleeve 24 surrounds a section of the shaft 16 and is fixed to rotate with the shaft. The inner cylindrical surface of the bore of stuffing box 12 and the outer cylindrical surface of sleeve 24 defines an annular gap 28. The annular gap 28 is filled with a packing material 30 to form a seal between the stuffing box 12 and the shaft sleeve 24.

The packing material 30 is normally woven from fibers in a square or rectangular section which can be cut into annular rings. The packing material 30 is prevented from moving axially out of the stuffing box 12 by a gland plate 96. The gland plate 96 is attached to the stuffing box 12 by a series of bolts 97 disposed in a circular pattern.

As described above, the impeller shaft 16 can be manually adjusted axially along its axis to compensate for wear of the impeller 18, liner 22 or inner surface of pump impeller casing 20. As the shaft 16 is moved axially, the impeller 18 is moved axially closer to the inner surface of the casing at the inlet to compensate for wear. At the same time, the shaft sleeve 24 is also moved axially relative to the packing material 30. Since the radial distance from the interface of the shaft sleeve 24 and the packing material 30 to the axis of the shaft 16 is approximately equal throughout the entire interface, the sealing ability of the packing material 30 will generally stay the same when the shaft 16 is moved axially along its axis.

Mechanical seals are also used to seal the shaft and casing of the slurry pumps. Mechanical seals eliminate the need to manually adjust the packing follower. A prior art mechanical seal 134 suitable for use in a slurry pump arrangement is shown in FIG. 3. The prior art mechanical seal 134 is located within a stuffing box 112 attached to the pump casing which includes an enlarged diameter cylindrical bore 111. Mechanical seal 134 places the packing material illustrated in FIG. 2 as the sealing element.

The mechanical seal 134 includes a mating ring 148 fixed for rotation with a sleeve assembly 124 by a pin 156. The sleeve assembly 124 is attached to the shaft 116 by a collar 152. An axially movable primary ring 150 is retained within a stationary gland plate 196 and is axially biased by a spring 154. The spring 154 biases the primary ring 150 toward the mating ring 148 to bring a seal face of the primary ring toward contact with a seal face of the mating ring.

Replacing the packing material 30 of the sealing system 10 for a slurry pump, as illustrated in FIGS. 1 and 2, with a mechanical seal 134, as illustrated in FIG. 3, can greatly improve the sealing capability of the system. However, such a direct replacement could cause some problems not previously present with the use of packing material as the sealing element. As noted earlier, axial movement of the impeller shaft may be required to compensate for impeller wear. With the use of packing material, axial movement of the shaft relative to the packing material generally will not change the sealing ability of the sealing system 10 since the radial distance from the interface of shaft sleeve and the packing material to the axis of the shaft is approximately equal through out the entire interface. However, with the use of a mechanical seal as a direct replacement for the packing material, an axial movement of the shaft may significantly change the sealing ability of the sealing system. As the shaft is moved axially inward into the axial impeller casing, the distance between the gland 196 and the mating ring 148 increases axially. This in turn increases the axial distance of the cavity in which the spring is situated relative to mating ring 148 and thereby relaxes the spring and reduces the bias of the primary ring 150 toward the mating ring 148. A reduced bias of the primary ring 150 toward the mating ring 148 may reduce the sealing ability of the mechanical seal 134.

The present invention is directed to an improved slurry pump sealing system that employs a mechanical seal arrangement to seal the pump shaft relative to the pump casing but accommodates axial shaft adjustment without compromising the seal functionality. In this regard, the mechanical seal assembly is fixed to the bearing housing and impeller shaft and moves axially with the bearing housing and shaft. The relative axial relationship between the rotating and non-rotating seal components remains unchanged regardless of the axial position of the shaft, impeller, and bearing housing.

To accommodate such movement of the mechanical seal assembly relative to the pump casing, the sealing system of the present invention includes a contraction assembly having one stationary member associated with the pump casing and one movable member associated with the seal chamber defining housing and seal assembly contained within the seal chamber. Movement of the shaft in a direction toward the pump casing to adjust the internal clearance between the impeller and pump casing causes the movable member to move relative to the stationary member to accommodate the reduction of the distance between the pump casing and shaft bearing housing. An interconnecting member forms a contraction joint between these separate members and is sealed to contain the fluids within the pump casing and seal chamber.

DETAILED DESCRIPTION OF THE DRAWINGS

Figure 4:
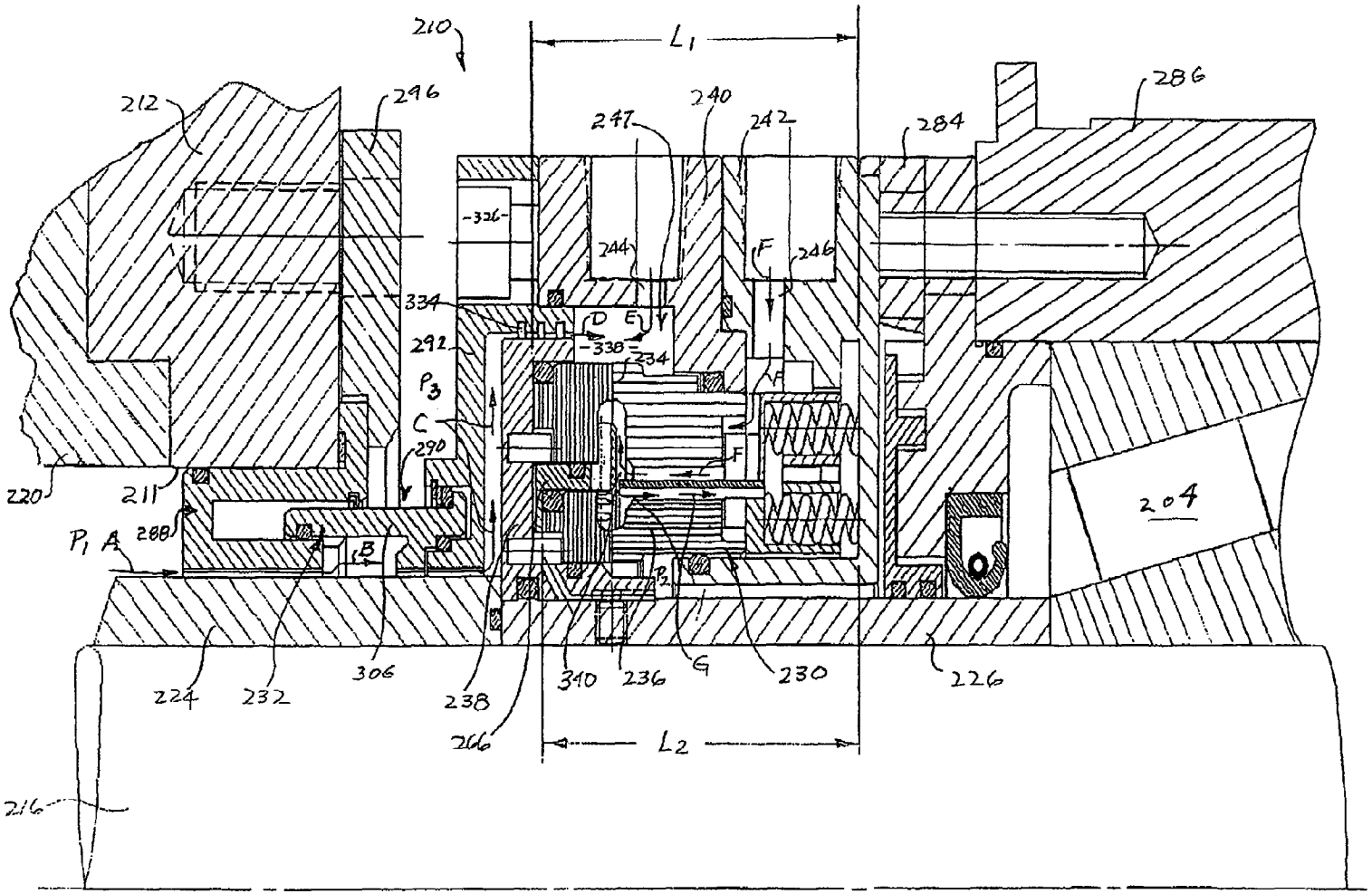
FIG. 4 is a sectional view of an embodiment of sealing system in accordance with the present invention that employs a telescoping interconnecting member to form the contraction assembly.
Figure 5:
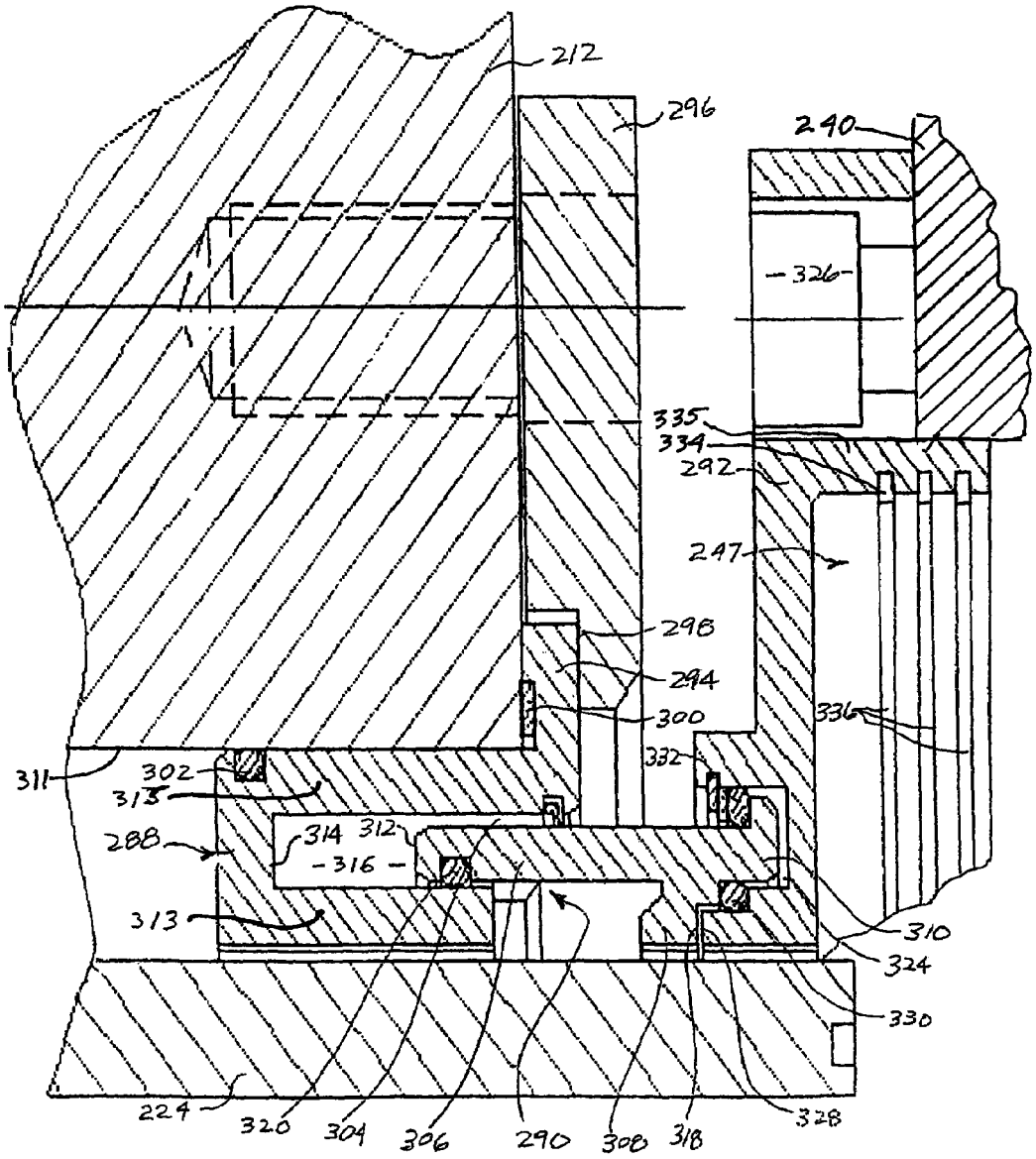
FIG. 5 is a sectional view of the telescoping interconnecting member arrangement of the sealing system of FIG. 4.
Figure 6:
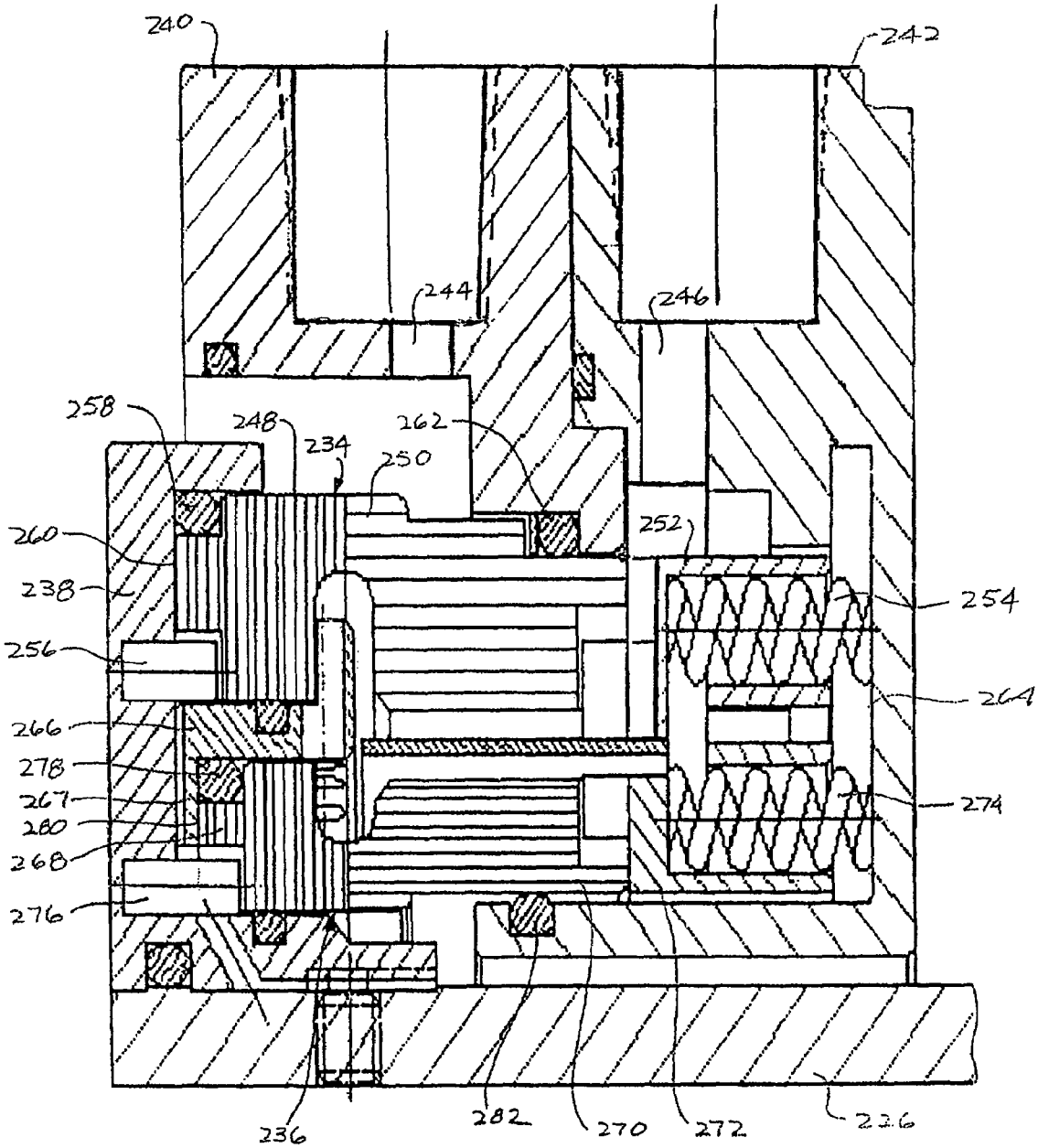
FIG. 6 is a sectional view of the seal assembly of the sealing system of FIG. 4.

An illustrative embodiment of a sealing system in accordance with the present invention is shown in FIGS. 4 to 6. For the purpose of describing the present invention, the term "rotationally fixed" is used to describe one component attached to another component in a manner such that both components rotate (or are non-rotatable) together. Also, a component fixed for axial movement with another component means that such components are attached or secured in a manner such that both components move together in the same axial direction and displacement. A component axially fixed to, or relative to, another component, means that it does not move axially relative to the other component.

A slurry pump having a casing 220 defining a pump cavity is axially fixed relative to a base or pedestal as described in connection with the slurry pump arrangement illustrated in FIG. 1. It is therefore fixed against axial movement. The pump includes an impeller (not shown) rotatably supported within the pump cavity of impeller casing 220 by a shaft 216 which includes a surrounding sleeve 224. The shaft 216 is rotatably supported on bearings such as bearings 4 of the arrangement of FIG. 1 within a bearing housing such as the bearing housing 7 of the arrangement of FIG. 1. It is here denominated a cartridge bearing/shaft assembly 286. As previously described with respect to the slurry pump arrangement of FIGS. 1 and 2, the shaft 216 is supported within cartridge bearing/shaft assembly 286 for rotation on bearings 204 arranged to maintain the shaft 216 in an essentially axially fixed relation relative to the bearing housing 286.

Figure 3:
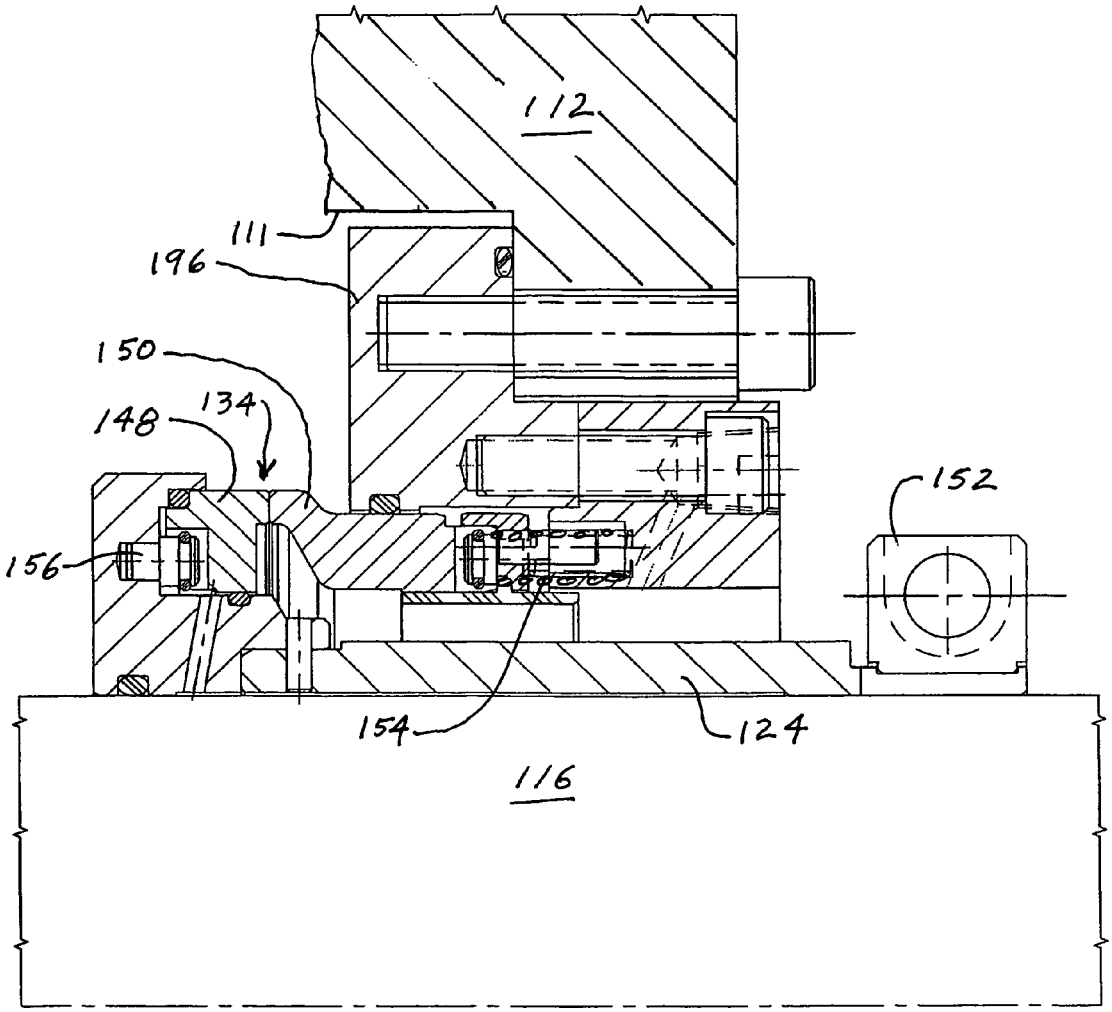
FIG. 3 (PRIOR ART)
FIG. 3 is a sectional view of a prior art mechanical seal arrangement for a slurry pump.

Pump casing 220 includes an annular stuffing box 212 defining an enlarged cylindrical bore surface 211 that surrounds the outer cylindrical surface of sleeve 224 on shaft 216 where it exists the pump casing. In an arrangement such as described with reference to FIG. 3, a mechanical seal assembly attached to gland plate 212 would occupy the annular space between the surface 211 and sleeve 224.

As described in connection with the slurry pump arrangement illustrated in FIGS. 1 and 2, the cartridge bearing/shaft assembly 286 of the illustrated embodiment of FIGS. 4 to 6 is supported on a pedestal or base and is slidable axially relative to the impeller pump casing 220 by a suitable support and adjustment mechanism such as the rails 6 and threaded shaft 8 with adjustment nuts 9 illustrated in FIG. 1. Adjustment of the mechanism moves the cartridge bearing/shaft assembly 286 axially toward the pump casing 220, as in the typical slurry pump arrangement of FIGS. 1 and 2.

The sealing system 210 is intended to seal the slurry within the chamber defined by the impeller pump casing 220. Because the shaft 216 is intended to rotate relative to the casing, a seal must be provided to prevent or inhibit leakage of the slurry.

The sealing system 210 includes a seal assembly generally designated 230 and a contraction assembly 232. The sealing system includes one or more annular gland plates or flanges attached to the cartridge bearing/shaft assembly 286 that surround shaft 216 and sleeve 226 and define a hollow seal chamber generally designated 247. These glands or flanges are fixed for axial movement with the cartridge bearing/shaft assembly 286. The hollow seal chamber 247 houses the seal assembly 230.

Referring to FIG. 4, an annular internal gland 240 and annular external gland 242 are attached to cartridge bearing/shaft assembly 286, between that assembly and pump casing 220. These glands surround the pump shaft 216 and define the seal chamber 247.

As shown in FIG. 4, the external gland 242 is attached and axially fixed relative to a bearing gland 284. The bearing gland 284 is attached and axially fixed for movement with cartridge bearing/shaft assembly 286 by bolts (not shown). As previously described above, the shaft 216 is axially fixed relative to cartridge bearing/shaft assembly 286. Therefore, the external gland 242 and the internal gland 240 move axially with the cartridge bearing/shaft assembly 286, shaft 216, sleeve 224 and pump impeller in the same direction, with the same displacement.

In accordance with the present invention, a contraction assembly 232 of the embodiment, illustrated in FIGS. 4 and 6, is a telescopic assembly with interengaged members forming a contraction or telescopic joint generally designated 290. It includes a stuffing box gland 288, a connection gland 292 and an interconnecting member in the form of a tubular extension 306. As will become apparent, the assembly 232 is the mechanism that forms the contraction or telescopic joint generally designated 290 and accommodates movement of the cartridge bearing/shaft assembly 286 axially toward the pump casing 220 during adjustment of the cartridge bearing/shaft assembly 286 toward the pump casing 220 to adjust the impeller-to-casing inner wall surface relationship.

The contraction assembly 232 includes a stationary member, fixed against axial movement, in the form of a stuffing box gland 288 and a movable member, in the form of connection gland 292 connected to the internal gland 240 and movable with the elements defining seal chamber 247. The stationary member, or stuffing box gland 288, surrounds shaft 216 and its associated sleeve 224 which are rotatable within the stuffing box gland 288. The stuffing box gland 288 is sealed relative to stuffing box 212 and contains the pressurized slurry within the impeller casing 220.

Referring particularly to FIG. 5, the stuffing box gland 288 includes a pair of concentric radial inner and outer axial rings 313 and 315 connected by radial end wall 314. The axial rings define an annular slot 304 open toward the cartridge bearing/shaft assembly 286 and terminating at a radial end wall 314. A tensor gland 296, having an annular groove 298 receives the rim 294 of the stuffing box gland 288 and clamps the stuffing box gland 288 axially against the stuffing box 212. Two elastomeric seals 300 and 302 seal the stuffing box gland 288 to the stuffing box 212.

The movable member in the form of connection gland 292 is axially fixed at its radially outward end to the internal gland 240 by bolts (not shown) inserted through bores 326 of the connection gland 292 and into a bore of the internal gland 240. The connection gland 292 is radially elongate and defines an end wall of the seal chamber 247 defined by the internal gland 240 and external gland 242. The external gland 242 and internal gland 240 and connection gland 292 define annular chamber 247 surrounding second shaft sleeve 226 and shaft 216. The chamber is sized to receive mechanical seal assembly 230.

The connection gland 292 also includes an annular portion 335 that defines an axial wall having three annular grooves. As shown in FIGS. 4 and 5, a flow retarding ring 334 is positioned within each annular groove. These rings provide a labyrinth type restriction to flow within seal chamber 247.

The connection gland 292 defines an axial annular recess or groove 324 near its radially inner end that faces toward the stuffing box gland 288. An abutment face 328 is defined radially inward of the recess 324.

The contraction assembly 232 includes an interconnecting member in the form of axially extending annular or tubular extension member 306, having a radially inwardly extending annular ridge 308 and an annular lip 310 at one end. The ridge 308 of the tubular extension defines an annular abutment face 318. The annular lip 310 of the tubular extension 306 is supported within the annular recess 324 of the connection gland 292. The abutment face 328 of the connection gland 292 is in abutting relation with the abutment face 318 of the tubular extension 306. Two O-rings 330 and 332 seal the tubular extension 306 to the connection gland 292.

The tubular extension 306 includes an opposite free end 312 positioned within the slot 304 of the stuffing box gland 288 between radial inner and outer axial rings 313 and 315. It is located a distance from the radial end wall 314 of the slot 304 to define an annular cavity 316 between the end 312 of the tubular extension 306 and the radial end wall 314 of the slot 304. The cavity 316 allows the tubular extension 306 to slide axially toward the stuffing box gland 288 to reduce the overall axial length of the telescopic contraction assembly 232. In the embodiment illustrated in FIGS. 4-6 a seal in the form of an O-ring 320 in a groove near free end 312 seals the tubular extension 306 to the stuffing box gland 288 in cavity 316 on the outer cylindrical surface of radial inner ring 313. It permits axial movement of the tubular extension 306 relative to the stationary member or stuffing box gland 288 within cavity 316.

Figure 5A:
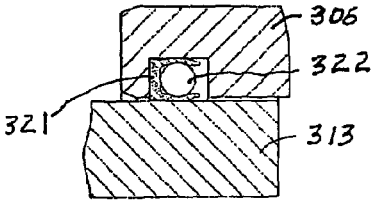
FIG. 5A is a fragmentary sectional view showing an alternative type of elastomeric seal for the embodiment of FIG. 4.

The seal 320 can be any known arrangement that permits axial movement while maintaining a fluid tight relationship between the relatively movable elements. FIG. 5A illustrates a seal 321 in the form of a polymeric seal ring of generally U-shaped cross section in which is positioned an annular coil spring 322. The seal 321 is positioned in a seal groove in tubular extension 306. It is also in sealing contact with the outer cylindrical surface of radial inner ring 313 of the stuffing box gland 288. This is a well known type of seal that permits relative axial movement between associated sealed surfaces.

Figure 5B:
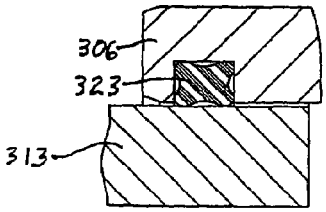
FIG. 5B is a fragmentary sectional view showing a further alternative type of elastomeric seal for the embodiment of FIG. 4.

FIG. 5B illustrates another type of seal that may be employed to seal between the stuffing box gland 288 and annular extension 306. It is an annular elastomeric ring 323 having a generally "X" shaped cross section. It is referred to as "quad ring" and is a well known seal ring configuration. Seal 323 is disposed in groove in the tubular extension 306 and is in sealing contact with the outer cylindrical surface of radial inner axial ring 313 of stuffing box gland 288. Other seals may also be used. For example, a seal of oval shaped cross section or rectangular cross section could be employed. A bellows could also be used.

As can be appreciated, the contraction or telescopic assembly 232 with stationary member or stuffing box gland 288 and movable member or connection gland 292, and interconnecting member in the form of a tubular extension member 306 provides a telescopic joint to accommodate movement of the internal gland 240 and external gland 242 toward the stuffing box 212. Tubular extension 306 has an end fixed to connection gland 292 and an end slidable within cavity 316 of stationary gland. The extension 306 is sealed relative to connection gland 292 and sealed relative to stuffing box gland 288. These members, therefore, define an annular, sealed chamber surrounding sleeve 224 on shaft 212 that is in essence an extension of the pump cavity defined by impeller casing 220. On adjustment of the impeller clearance the axial length of this chamber is shortened by an amount equal to the amount of adjustment of the cartridge bearing/shaft assembly 286 toward the pump casing 220.

As previously discussed in the "Background of the Invention" section, the impeller shaft 216 is adjusted axially along its axis to compensate for wear of the impeller or pump casing. With the sealing system 210 of the present invention, adjustment of the impeller shaft 216 a certain axial distance is accomplished by moving the cartridge bearing/shaft assembly 286 since the shaft 216 that drives the impeller is fixed for axial movement with cartridge bearing/shaft assembly 286. Likewise, the external gland 242 is fixed for axial movement with the cartridge bearing/shaft assembly 286 and the internal gland 240 fixed for axial movement with the external gland 242, and the connection gland 292 fixed for axial movement with the internal gland 240. Thus, the internal gland 240, the external gland 242 and the connection gland 292 also move the same axially distance.

Referring to FIG. 5, the abutment face 328 of the connection gland 292 abuts the abutment face 318 of the tubular extension 306 to move the tubular extension 306 axially within the slot 304 of the stuffing box gland 288 and reduce the overall axial length of the contraction assembly 232.

Figure 1:
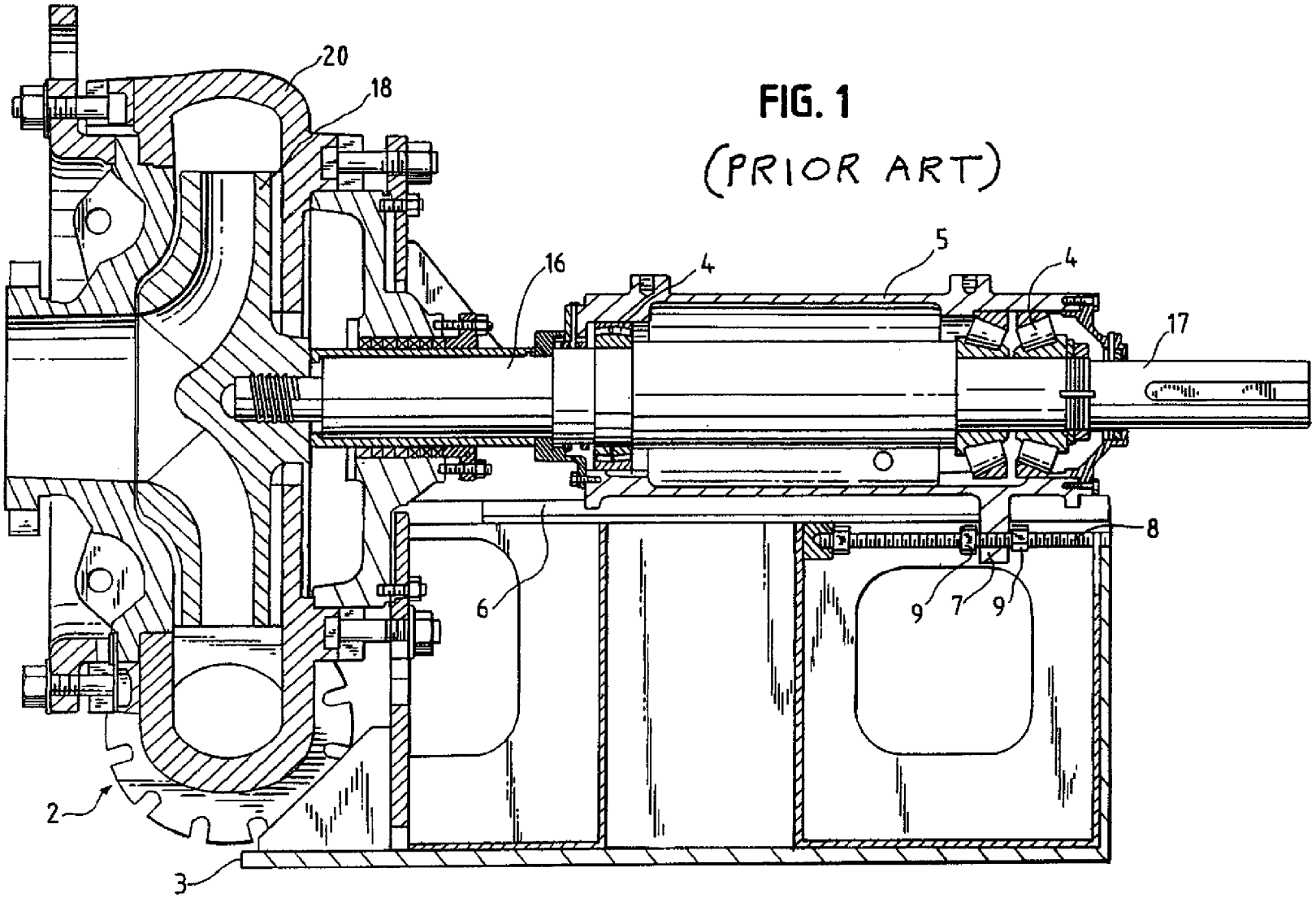
FIG. 1 (PRIOR ART)
FIG. 1 is a sectional view of a prior art slurry pump arrangement.
Figure 2:
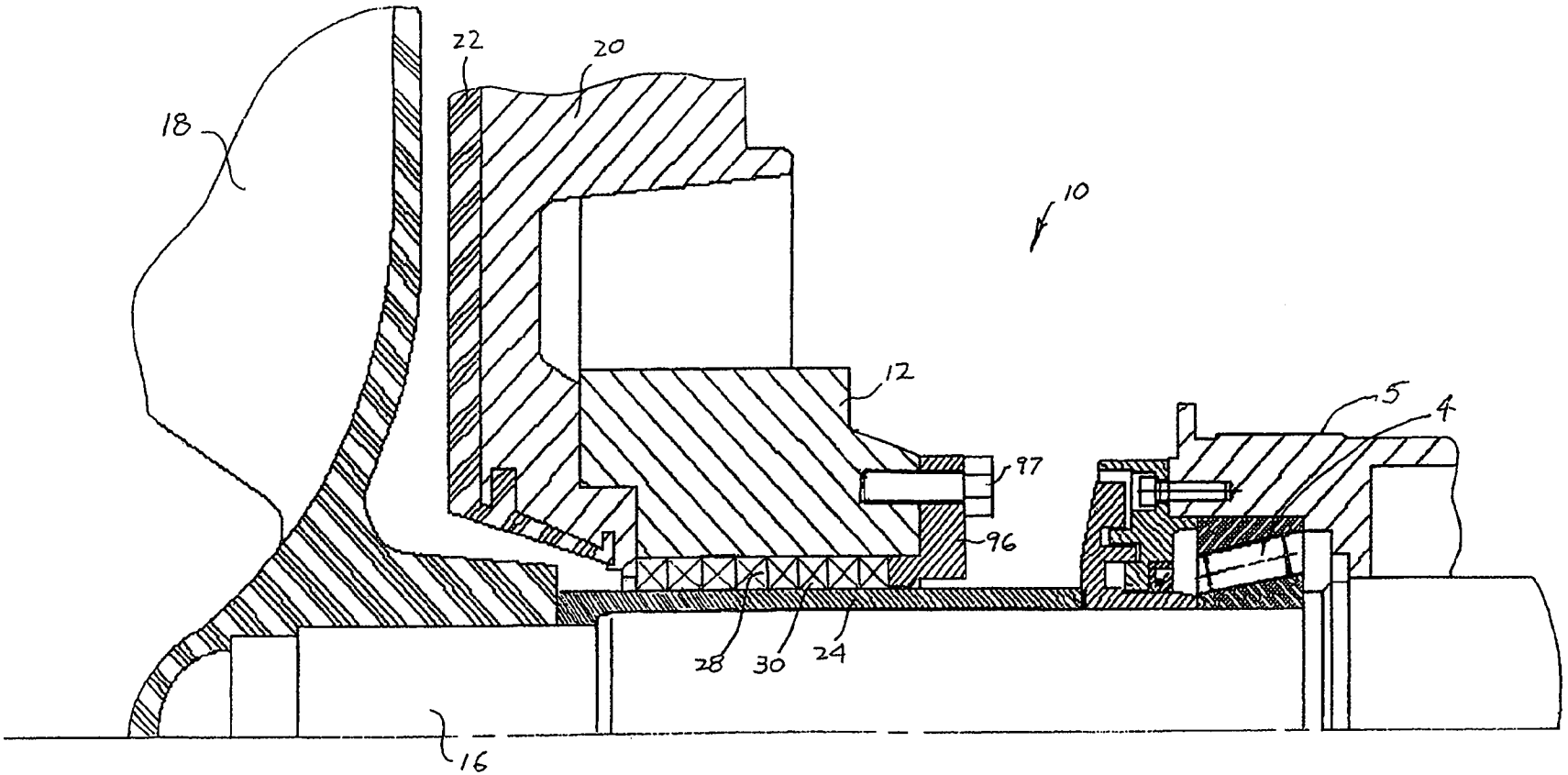
FIG. 2 (PRIOR ART)
FIG. 2 is a sectional view of a prior art sealing system for a slurry pump using packing.

Axial movement of the cartridge bearing/shaft assembly 286, for example, by adjustment of the threaded screw and nut arrangement illustrated in FIG. 1 moves the cartridge bearing/shaft assembly 286 closer to the stuffing box gland 212 on pump impeller casing 220. The external gland 242, internal gland 240 and connection gland 292 that define the seal chamber 247 for seal assembly 230 move axially closer to gland 212 by the same amount.

The axial adjustment does reduce the axial distance between the connection gland 292 and stuffing box gland 288.

Such change is accommodated by axial shortening of the telescoping joint 290. Interconnecting member or tubular extension 306 is fixed for axial movement with connection gland 292. Movement of connection gland 292 causes the free end of tubular extension 306 to move axially further into the annular slot 304 defined by stuffing box gland 288. Seal 320 accommodates this sliding movement and maintains the integrity of the entire internal chamber surrounding sleeve 224 of shaft 216 that extends through the contraction assembly 232.

The seal assembly 230, illustrated in FIGS. 4 and 6, is of the double concentric seal arrangement. It should be noted that the features of this invention can be utilized with a single, tandem or double seal arrangement. The double seal arrangement or the tandem seal arrangement can be concentric or in-line. For the most part, the elements of the seal arrangement, whether a single seal or a tandem seal is used, are similar to those elements of a conventional seal are well known in the sealing of slurry pumps.

Referring to FIGS. 4 and 6, the seal assembly 230 illustrated includes an external seal 234 and an internal seal 236 disposed radially inward of the external seal. The seals 234 and 236 are situated in the space or seal chamber 247 defined by an internal gland 240 and an external gland 242 and connector gland 292. The internal gland 240 defines a dilution fluid passageway 244. The external gland 242 defines a barrier/coolant fluid passageway 246.

A rotating body 238 is rotationally fixed relative to a second shaft sleeve 226 which is rotatable with the shaft 216. The shaft 216 is axially fixed to its associated impeller. It is also axially fixed relative to cartridge bearing/shaft assembly 286. The bearing gland 284, internal gland 240, external gland 242, connector gland 292 are axially fixed relative to the cartridge bearing/shaft assembly 286. The stuffing box 212 and stuffing box gland 288 are axially fixed relative to the pump casing 220 and the pedestal that supports the pump. The second shaft sleeve 226 is mounted on the shaft 216 and rotates and moves axially with the shaft 216.

Referring to FIG. 6, the external seal 234 includes an external mating ring 248, an axially movable external primary ring 250, an external traction ring 252 and an external seal biasing element 254. The external mating ring 248 is rotationally fixed relative to the rotating body 238 by a pin 256. The external mating ring 248 includes a mating ring seal face. The opposite surface of the external mating ring 248 is in abutting relation with an abutment surface 260 of the rotating body 238. An O-ring 258 seals the external mating ring 248 to the rotating body 238 so that no leakage occurs through the connection. The external primary ring 250 is positioned adjacent to a radially inward facing surface of the external gland 240. An O-ring 262 seals the external primary ring 250 to the internal gland 240. The internal primary ring 250 includes a primary seal face. The external primary ring 250 is axially biased by the external seal biasing element 254. The external traction ring 252 is situated axially between the internal primary ring 250 and the internal seal biasing element 254. The opposite end of the external seal biasing element 254 is in abutting relation with an abutment surface 264 of the external gland 242. The external seal biasing element 254 biases the external primary ring 250 toward the external mating ring 248, bringing the primary ring seal face toward contact with the mating ring seal face.

The internal seal 236 includes an internal mating ring 268, an axially movable internal primary ring 270, an internal traction ring 272 and an internal seal biasing element 274. The internal mating ring 268 is rotationally fixed relative to the rotating body 238 by a pin 276. A cooler ring 266 is situated between the external mating ring 248 and the internal mating ring 268. A radially inwardly extending rim 267 of the cooler ring 266 is situated between the internal mating ring 268 and the rotating body 238. The internal mating ring 268 includes a mating ring seal face. The opposite surface of the internal mating ring 268 is in abutting relation with an abutment surface 280 of the cooler ring 266. An O-ring 278 seals the internal mating ring 268 to the cooler ring 266 so that no leakage occurs through the connection. The internal primary ring 270 is positioned adjacent to a radially outward facing surface of the external gland 242. An O-ring 282 seals the internal primary ring 270 to the external gland 242.

The internal primary ring 270 includes a primary seal face. The internal primary ring 270 is axially biased by the internal seal biasing element 274. The internal traction ring 272 is situated axially between the internal primary ring 270 and the internal seal biasing element 274. The opposite end of the internal seal biasing element 274 is in abutting relation with the abutment surface 264 of the internal gland 242. The internal seal biasing element 274 biases the internal primary ring 270 toward the internal mating ring 268, bringing the primary ring seal face toward contact with the mating ring seal face. It should be noted that while FIGS. 4 and 6 illustrate the external seal biasing element 254 and the internal seal biasing element 274 as coil springs, other types of biasing elements can be used in place of the coil springs. A bellows arrangement could also be used.

In examining the seal assembly 230 is readily understood that certain elements of the seals 234 and 236 are stationary or non-rotatable, and certain elements rotate with the shaft. For example, the mating rings 248 and 268 are attached to rotating body 238 which is rotationally fixed for rotation with shaft 216. Since these elements are also axially fixed relative to the shaft 216, axial adjustment of the shaft causes axial movement of the rotating elements of seal rings 248 and 268.

Similarly seal elements such as primary rings 250 and 270 and the associated components such as traction rings 252 and 272, and biasing elements 254 and 274 are rotationally fixed against rotation relative to internal gland 242 and internal gland 240. These non-rotating elements are axially fixed relative to the gland 240 and gland 242 and connection gland 292 which define the seal chamber 247. Thus, since these glands move axially with the cartridge bearing/shaft assembly 286, the stationary seal elements move axially on axial adjustment of the cartridge bearing/shaft assembly 286 relative to pump impeller casing 220 to move shaft 216. Therefore, all components of seals 234 and 236 of seal assembly 230 move with the cartridge bearing/shaft assembly 286 and no change occurs in the axial position of the rotating and non-rotating elements relative to each other. No adverse or deleterious effect on seal performance results from adjustment of the impeller-to-casing clearance.

With the rotating body 238 axially fixed to the second sleeve 226 and the second sleeve 226 axially fixed to the impeller shaft 216, adjusting the impeller shaft 216 a certain axial distance moves the rotating body 238 by the same axial distance allowing the axial length $L_1$ of the external seal 234 to remain the same. Similarly, since the cooler ring 266 is axially attached to the rotating body 238, both the cooler ring 266 and the external gland 242 move by the same axial distance allowing the axial length $L_2$ of the external seal 242 to remain the same. With the axial length $L_1$ of the internal seal 240 remaining the same, the spring force of the internal seal biasing element 254 remains the same and the sealing capability of the internal seal 240 also remains the same. Likewise, with the axial length $L_2$ of the internal seal 236 remaining the same, the spring force of the external seal biasing element 274 remains the same and the sealing capability of the external seal 236 also remains the same. Therefore, the sealing system 210 of the present invention allows the impeller shaft 216 to be adjusted axially along its axis to compensate for impeller or pump casing wear without affecting the sealing capability of the sealing system 210.

Referring to FIG. 4, the sealing system 210 of the present invention operates as follows. The sealing system 210 contains high pressure slurry from zone $P_1$ in the chamber defined by the impeller casing, upstream of the seal assembly 230. A low pressure zone $P_2$ exists downstream of the seals 234 and 236 of seal assembly 230. A low pressure zone $P_3$ also exists outward of the telescopic contraction assembly 232 which extends between the stuffing box 212 and internal gland 240.

The seal assembly 230 functions to prevent the escape of slurry located in the high pressure zone $P_1$ to the low pressure zone $P_2$ downsteam of seals 234 and 236. The telescopic contraction assembly 232 functions to prevent the escape of slurry located around sleeve 224 between sleeve 224 and the cylindrical bore 211 of stuffing box 212 to low pressure zone $P_3$ between the stuffing box 212 and the internal gland 240.

The slurry from the chamber in the high pressure zone $P_1$ is able to flow through a flow path defined by the first shaft sleeve 224 and the inner ring 313 of stuffing box gland 288 as indicated by arrow A. The slurry then flows through a flow path defined by the first shaft sleeve 224 and the contraction assembly 232 as indicated by arrow B. The slurry is prevented from flowing between the stuffing box 212 and stuffing box gland 288 by seals 302 and 300. It is prevented from flowing between the tubular extension 306 and the inner axial ring 313 of stuffing box gland 288 by seal 320, here illustrated as an O-ring 320 as seen in FIG. 5. The slurry is prevented from flowing between the tubular extension 306 and the connection gland 292 by O-rings 330 and 332.

The slurry flows from the chamber of pump casing 220 through the area sealed by contraction assembly 232 and then along a radial flow path defined by the connection gland 292 and the rotating body 238 as indicated by arrows C into a dilution chamber 338 as indicated by arrow D. Chamber 338 is a part of the overall seal chamber 247. The slurry is there diluted by a dilution fluid flowing from the dilution fluid passageway 244 of the internal gland 240 as indicated by arrow E. To dilute the slurry, the viscosity of the dilution fluid, preferably water, is less than the viscosity of the slurry. The pressure of the dilution fluid in the dilution fluid passageway 244 is preferably 15 to 30 psi higher than the pressure of the slurry in zone $P_1$. This higher pressure of the dilution fluid allows the dilution fluid to mix with the slurry in the dilution chamber 338. The flow retarding rings 334 inhibit the diluted slurry from flowing upstream out of the dilution chamber 338.

A barrier/coolant fluid, such as water or lube oil, flow from the barrier/coolant fluid passageway 246 of the external gland 242 through an inlet flow path as indicated by arrows F and into a cooling chamber 340 located between sealing interfaces of the external seal 234 and the internal seal 236. Chamber 340 is also a part of the overall seal chamber 247. The pressure of the barrier/coolant fluid is preferably 15 to 30 psi higher than the pressure of the diluted slurry in the dilution chamber 338. The barrier/coolant fluid serves two purposes once it reaches the sealing interface of the external seal 234. First, since the barrier/coolant fluid is at a pressure higher than the diluted slurry, the barrier/coolant fluid is able to assist in preventing or inhibiting the diluted slurry from flowing through the interface between the external mating ring 248 and the external primary ring 250. Second, the barrier/coolant fluid is able to absorb some of the heat generated by the seal face of the external mating ring 248 rubbing against the seal face of the external primary ring 250. The barrier/coolant fluid then flows by the sealing interface of the internal seal 236 wherein the fluid picks up some of the heat generated by the seal face of the internal mating ring 268 rubbing against the seal face of the internal primary ring 270. Thereafter, the heated barrier/coolant fluid flows through an outlet flow path as indicated by arrows G in FIG. 4 to be cooled and filtered in a separate reservoir (not shown) for recirculation.

Figure 7:
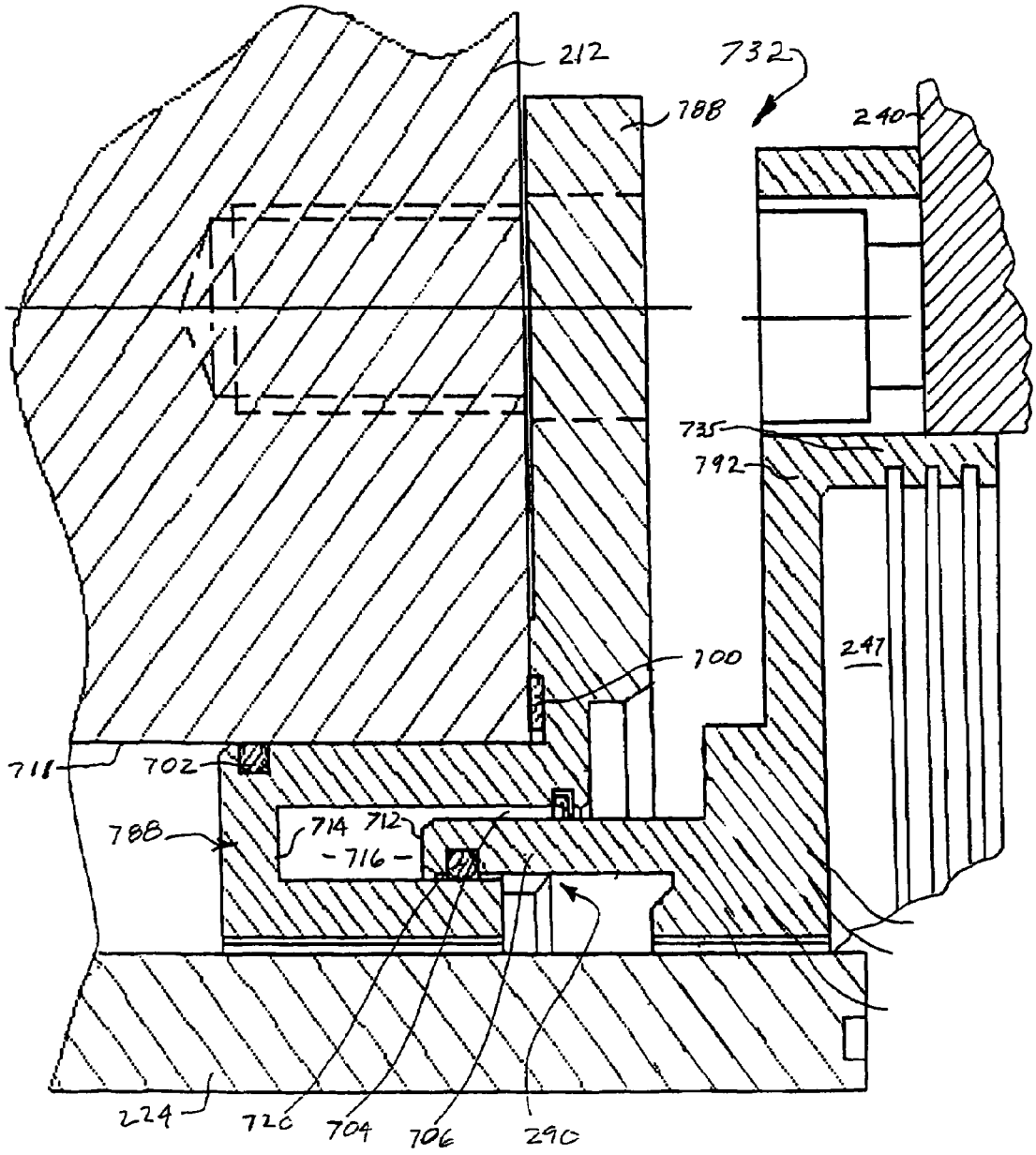
FIG. 7 is a sectional view showing a modified form of the telescoping interconnecting member for the embodiment of FIG. 4.

FIG. 7 shows an alternative embodiment for the telescopic contraction assembly 232 of the embodiment of FIGS. 4 to 6. As in the previous embodiment, a telescopic contraction assembly, designated 732, extends between stuffing box 212 and internal gland 240. It includes a stuffing box gland 788 and a connection gland 792. As in the embodiment of FIGS. 4-6, the slurry pump arrangement includes an impeller casing 220, with a stuffing box 212, a shaft 216 with sleeve 224, and a cartridge bearing/shaft assembly 286 to which are secured an internal gland 240 and an external gland 242.

Stuffing box gland 788 is an integration, into a single component, of stuffing box gland 288 of the embodiment of FIGS. 4 to 6 with tensor gland 296. Elastomeric seals 700 and 702 seal the stuffing box gland 788 to stuffing box 212. The stuffing box gland 788 includes radial inner axial ring 713 and radial outer axial ring 715 that define an axially extending annular slot 704 terminating at radial end wall 714.

The movable member in the form of connection gland 792 is axially fixed at its radially outward end for movement with to the internal gland 240. The connection gland 792 is radially elongate, and defines an end wall of the seal chamber 247 defined by the internal gland 240 and external gland as in the embodiment of FIGS. 4-6. The connection gland 792 also includes an annular portion 335 that defines an axial wall having three annular grooves. As shown in FIGS. 4 and 5, a flow retarding ring, such as ring 334 of FIGS. 4 and 5, is positioned within each annular groove. These rings provide a labyrinth type restriction to flow within seal chamber 247.

The connection gland 792 includes an integrally formed axially extending interconnecting member in the form of an annular or tubular extension member 706. The tubular extension 706 includes a free end 712 positioned within the slot 704 of the stuffing box gland 788. It is located a distance from the radial end wall 714 of the slot 704 to define an annular cavity 716 between the end 712 of the tubular extension 706 and the radial end wall 714 of the slot 704. The cavity 716 allows the tubular extension 706 to slide axially toward the stuffing box gland 788 to reduce the overall axial length of the telescopic assembly 732. An O-ring 720 in a groove near free end 712 seals the tubular extension 706 to the stuffing box gland 788 in cavity 716 and accommodates axial movement of the end 712 of tubular extension 706 relative to the stuffing box gland 788.

As can be appreciated, the contraction assembly 732 with stationary member or stuffing box gland 788 and movable member or connection gland 792, and interconnecting member in the form of tubular extension member 706 provides a telescopic joint designated 290 to accommodate movement of the internal gland 240 an external gland toward the stuffing box 212. Tubular extension 706 has one end integral with connection gland 792 and has a free end slidable within cavity 716 of stationary gland 788. The extension 706 is sealed relative to connection gland 792 and sealed relative to stuffing box gland 788 by O-ring 720. These members, therefore, define an annular, sealed chamber surrounding sleeve 224 on shaft 216 that is in essence an extension of the pump cavity defined by the impeller casing 220. On adjustment of the impeller clearance the axial length of this chamber is shortened or contracted by an amount equal to the amount of adjustment of the cartridge bearing/shaft assembly 286 toward the pump casing 220.

Figure 8:
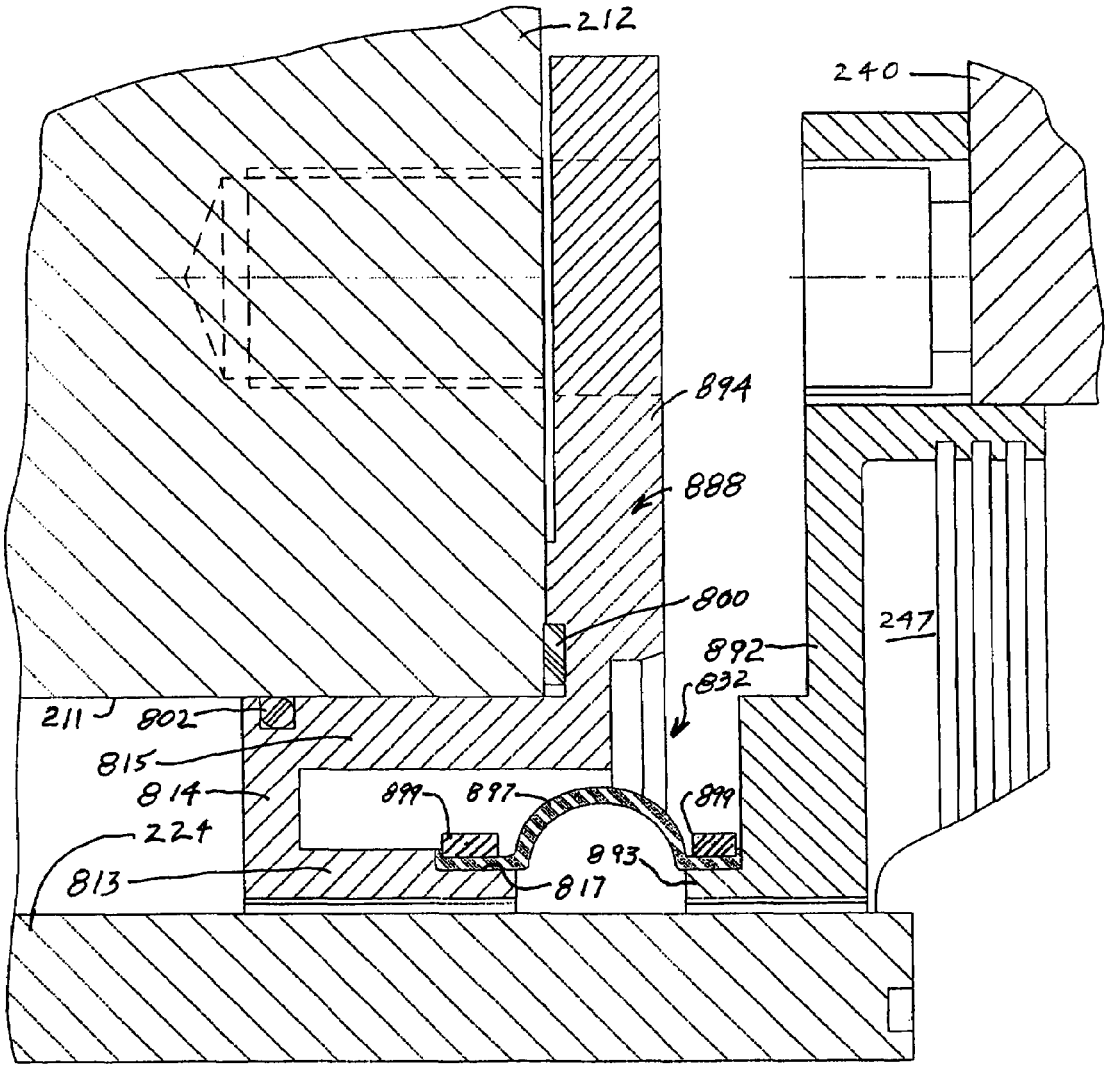
FIG. 8 is an alternative embodiment of a sealing system in accordance with the present invention employing a modified form of contraction assembly.

FIG. 8 illustrates a modified arrangement for the contraction assembly 232 of the embodiment of FIGS. 4-6. Here the contraction assembly, designated 832, extends between stuffing box 212 attached to pump casing and an internal gland 240 attached to the cartridge bearing/shaft assembly such as the cartridge bearing/shaft assembly 286 of the embodiment of FIGS. 4-6. It is annular about the impeller shaft and sleeve 224 and provides a fluid tight assemblage that extends between the stuffing box 212 and the internal gland 240 that surrounds the mechanical seal assembly connected to the cartridge bearing/shaft assembly.

In this embodiment, the contraction assembly 232 includes an annular stuffing box gland 888 connected to stuffing box 212 axially fixed relative to the pump casing. It includes concentric inner and outer rings 813 and 815 connected by radial end wall 814. The rings 813 and 815 are disposed between cylindrical bore 211 of stuffing box 212 and outer cylindrical surface of shaft sleeve 224. A radial rim 894 extends from ring 815 and is secured to stuffing box 212. Stuffing box gland 288 is sealed to the stuffing box 212 by elastomeric seals 800 and 802.

Inner axial annular ring 813 includes a reduced diameter surface 817 at its free end.

The contraction assembly 832 illustrated in FIG. 8 includes a connection gland 892 axially fixed relative to the cartridge shaft/bearing assembly. It is an annular member secured to internal gland 240 and forms the radial end wall of the seal chamber 247. Connection gland 892 includes an annular axial shoulder 893 that defines an axial cylindrical surface of about the same diameter as the reduced diameter surface 817 of the radially inner axial annular ring 813 of stuffing box gland 888.

In accordance with this embodiment of the invention the contraction assembly 832 provides a fluid tight contracting joint between the stuffing box 212 and the internal gland 240. The contraction assembly 832 of the embodiment of FIG. 8 includes an interconnecting member in the form of an annular, elastomeric or rubber bellows 897 secured in fluid tight relation by clamps 899 to reduced diameter surface 817 on stuffing box gland 888 and the cylindrical surface defined by annular axial shoulder 893 of connection gland 892.

The bellows 897 contracts axially and accommodates movement of the cartridge bearing/shaft assembly toward the pump casing on adjustment of the impeller-to-casing clearance.

Figure 9:
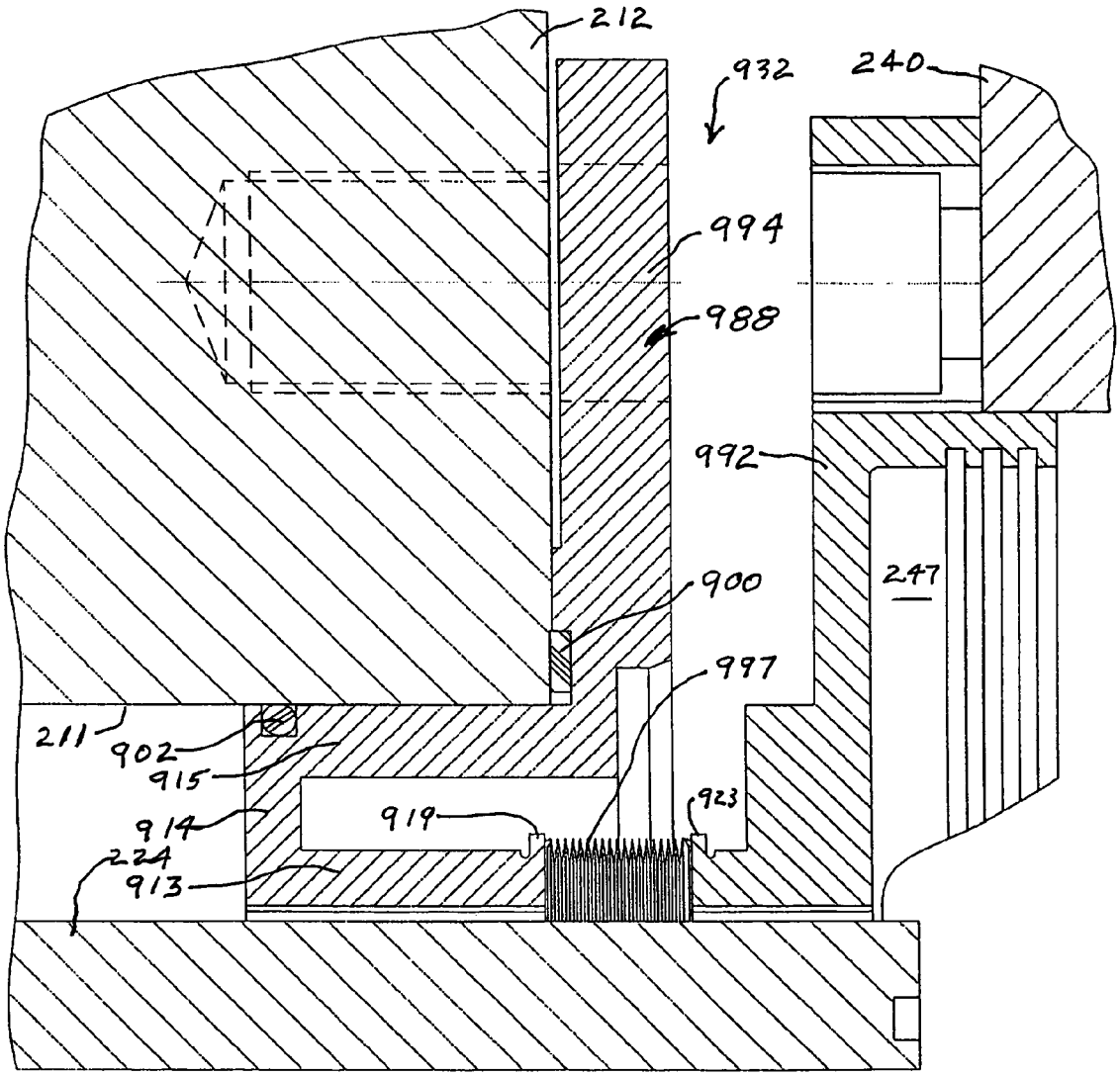
FIG. 9 is a further alternative embodiment of a sealing system in accordance with the present invention employing a further modified form of contracton assembly.

A further embodiment of the sealing system for slurry pumps is illustrated in FIG. 9. As in the earlier embodiments, the pump impeller clearance relative to the pump casing is periodically adjusted to maintain efficient operation after wear or erosion of the internal pump components occurs. The pump casing is axially fixed on a base or pedestal. The cartridge bearing/shaft assembly is movable relative to the base and axially adjustable toward the pump casing. Since the pump shaft is axially fixed relative to the cartridge bearing/shaft assembly, movement of that component moves the shaft and impeller by the same amount and provides adjustment of the impeller clearance.

The mechanical seal assembly of the sealing system is affixed to the cartridge bearing/shaft assembly within a seal chamber. The rotating and non-rotating components of the seal assembly are connected to the shaft and to the cartridge bearing/shaft assembly such that all components move axially the same distance as the axial movement of the impeller to adjust pump impeller-to-casing clearance. No change in seal performance results from such adjustment.

Axial movement of the cartridge bearing/shaft assembly reduces the distance between that component and the pump casing. In the embodiment of FIG. 9 such contraction of the distance is accommodated by a contraction assembly 932.

Referring to FIG. 9 the contraction assembly, designated 932, extends between stuffing box 212 attached to pump casing 220 and internal gland 240 attached to the cartridge bearing/shaft assembly. It is annular about the impeller shaft and sleeve 224 and provides a fluid tight assemblage that extends between the stuffing box 212 and the internal gland 240 that surrounds the mechanical seal assembly connected to the cartridge bearing/shaft assembly.

In this embodiment, the contraction assembly 932 includes an annular stuffing box gland 988 connected to stuffing box 212 and axially fixed relative to the pump casing. It includes concentric inner and outer rings 913 and 915 connected by radial end wall 914. The rings 913 and 915 are disposed between cylindrical bore 211 of stuffing box 212 and outer cylindrical surface of shaft sleeve 224. A radial rim 994 extends from ring 915 and is secured to stuffing box 212. The stuffing box gland 988 is sealed to the stuffing box 212 by elastomeric seals 900 and 902.

Inner axial annular ring 913 includes an annular radial flange 919 at its free end.

The contraction assembly 932 illustrated in FIG. 9 includes a connection gland 992 axially fixed relative to the cartridge shaft/bearing assembly. It is an annular member secured to internal gland 240 and forms the radial end wall of the seal chamber 247. Connection gland 992 includes an annular axial shoulder 993 that terminates in an annular radial flange 923 about the same diameter as the radial flange 919 of the radially inner axial annular ring 913 of stuffing box gland 988.

In accordance with this embodiment of the invention, the contraction assembly 932 provides a fluid tight contracting joint between the stuffing box gland 988 and the connection gland 992. The contraction assembly 932 of the embodiment of FIG. 9 includes an interconnecting member in the form of an annular, metal bellows 997 secured in fluid tight relation to radial flange 919 on stuffing box gland 988 and radial flange 923 of connection gland 992. The bellows 997 contracts axially and accommodates movement of the cartridge bearing/shaft assembly toward the pump casing on adjustment of the impeller-to-casing clearance.

The bellows is a well known sealing device and can be made by hydroforming a tube or by a series of annular rings welded at their inner and outer perimeter to form an accordion-like assembly. Stainless steel is a suitable material for bellows 997. The end ring at one end is welded in fluid tight relation to flange 919 of stuffing box gland 913. The end ring at the other end of bellows 997 is welded in fluid tight relation to the flange 923 of connection gland 992.

Other alterations and modifications may also become obvious to a person of ordinary skill in the art after a full understanding of the present invention is attained. For example, the stuffing box gland could include a tubular extension and the connection gland could define a cavity to receive a free end of the extension in a fluid tight axially sliding relation. Also, it is contemplated that the seal chamber 247 could be defined by a single gland plate of sufficient axial length to accommodate the mechanical seal assembly employed.

For these reasons the above embodiments should be considered as examples only, and not as limiting the scope of this invention. The scope of the invention should only be considered in the full context of the following claims.

The invention claimed is:

1. A sealing system for a slurry pump having a pump casing and a bearing housing spaced from said pump casing and supported for axial movement relative to said casing, a shaft rotatably supported by said bearing housing and fixed for axial movement with said bearing housing relative to said pump casing;

said system includes a contraction assembly having a stationary member secured to said pump casing and surrounding said shaft;

a movable member secured to said bearing housing for movement with said bearing housing and surrounding said shaft; and an interconnecting member defining a contraction joint between said stationary and movable members to accommodate movement of said bearing housing.

2. A sealing system as claimed in claim 1 wherein at least one gland plate is attached to said bearing housing, said at least one gland plate is annular and surrounds said shaft, and defines a seal assembly chamber surrounding said shaft and wherein said movable member is secured to said at least one gland plate.

3. A sealing system as claimed in claim 2 wherein a seal assembly is disposed in said seal chamber.

4. A sealing system as claimed in claim 3 wherein said seal assembly includes at least one mechanical seal having at least one seal ring connected to said shaft for rotation and axial movement therewith and a seal ring connected to said movable member for axial movement therewith.

5. A sealing system as claimed in claim 4 wherein said seal assembly includes two seal rings connected to said shaft for rotation and axial movement therewith and said seal assembly includes two seal rings connected to said movable member for axial movement therewith, each one of said rings connected to said shaft being in relatively rotating sealing relation with one of said two rings connected to said movable member.

6. A sealing system as claimed in claim 1 wherein said contraction assembly defines a telescopic joint and said interconnecting member is a tubular extension surrounding said shaft extending from one of said stationary member and movable member having a free end slidable relative to the other of such members, said tubular extension disposed in sealing relation to each said stationary and movable members.

7. A sealing system as claimed in claim 6 wherein said tubular extension is fixed for axial movement with said movable member and slidable relative to said stationary member.

8. A sealing system as claimed in claim 7 wherein said stationary member includes radially inner and outer axial rings connected by a radial end wall that define an annular slot, said tubular extension extends into said annular slot and is sealed to said stationary member by a seal that permits axial movement of said tubular extension relative to said stationary member within said annular slot.

9. A sealing system as claimed in claim 8 wherein said seal is an O-ring seal.

10. A sealing system as claimed in claim 2 wherein said contraction assembly defines a telescopic joint and said interconnecting member is a tubular extension surrounding said shaft extending from one of said stationary member and movable member having a free end slidable relative to the other of such members, said tubular extension disposed in sealing relation to each said stationary and movable members.

11. A sealing system as claimed in claim 10 wherein said tubular extension is fixed for axial movement with said movable member and slidable relative to said stationary member.

12. A sealing system as claimed in claim 11 wherein said stationary member includes radially inner and outer axial rings connected by a radial end wall that define an annular slot, said tubular extension extends into said annular slot and is sealed to said stationary member by a seal that permits axial movement of said tubular extension relative to said stationary member within said annular slot.

13. A sealing system as claimed in claim 12 wherein said seal is an O-ring seal.

14. A sealing system as claimed in claim 3 wherein said contraction assembly defines a telescopic joint and said interconnecting member is a tubular extension surrounding said shaft extending from one of said stationary member and movable member having a free end slidable relative to the other of such members, said tubular extension disposed in sealing relation to each said stationary and movable members.

15. A sealing system as claimed in claim 14 wherein said tubular extension is fixed for axial movement with said movable member and slidable relative to said stationary member.

16. A sealing system as claimed in claim 15 wherein said stationary member includes radially inner and outer axial rings connected by a radial end wall that define an annular slot, said tubular extension extends into said annular slot and is sealed to said stationary member by a seal that permits axial movement of said tubular extension relative to said stationary member within said annular slot.

17. A sealing system as claimed in claim 16 wherein said seal is an O-ring seal.

18. A sealing system as claimed in claim 4 wherein said contraction assembly defines a telescopic joint and said interconnecting member is a tubular extension surrounding said shaft extending from one of said stationary member and movable member having a free end slidable relative to the other of such members, said tubular extension disposed in sealing relation to each said stationary and movable members.

19. A sealing system as claimed in claim 18 wherein said tubular extension is fixed for axial movement with said movable member and slidable relative to said stationary member.

20. A sealing system as claimed in claim 19 wherein said stationary member includes radially inner and outer axial rings connected by a radial end wall that define an annular slot, said tubular extension extends into said annular slot and is sealed to said stationary member by a seal that permits axial movement of said tubular extension relative to said stationary member within said annular slot.

21. A sealing system as claimed in claim 20 wherein said seal is an O-ring seal.

22. A sealing system as claimed in claim 5 wherein said contraction assembly defines a telescopic joint and said interconnecting member is a tubular extension surrounding said shaft extending from one of said stationary member and movable member having a free end slidable relative to the other of such members, said tubular extension disposed in sealing relation to each said stationary and movable members.

23. A sealing system as claimed in claim 22 wherein said tubular extension is fixed for axial movement with said movable member and slidable relative to said stationary member.

24. A sealing system as claimed in claim 23 wherein said stationary member includes radially inner and outer axial rings connected by a radial end wall that define an annular slot, said tubular extension extends into said annular slot and is sealed to said stationary member by a seal that permits axial movement of said tubular extension relative to said stationary member within said annular slot.

25. A sealing system as claimed in claim 24 wherein said seal is an O-ring seal.

26. A sealing system as claimed in claim 1 wherein said interconnecting member of said contraction assembly is a bellows extending between said stationary member and movable member and is disposed in sealing relation to each said stationary and movable members.

27. A sealing system as claimed in claim 2 wherein said interconnecting member of said contraction assembly is a bellows extending between said stationary member and movable member and is disposed in sealing relation to each said stationary and movable members.

28. A sealing system as claimed in claim 3 wherein said interconnecting member of said contraction assembly is a bellows extending between said stationary member and movable member and is disposed in sealing relation to each said stationary and movable members.

29. A sealing system as claimed in claim 4 wherein said interconnecting member of said contraction assembly is a bellows extending between said stationary member and movable member and is disposed in sealing relation to each said stationary and movable members.

30. A sealing system as claimed in claim 5 wherein said interconnecting member of said contraction assembly is a bellows extending between said stationary member and movable member and is disposed in sealing relation to each said stationary and movable members.

31. A sealing system as claimed in claim 1 wherein said interconnecting member of said contraction assembly is an elastomeric or rubber bellows extending between said stationary member and movable member and is disposed in sealing relation to each said stationary and movable members.

32. A sealing system as claimed in claim 2 wherein said interconnecting member of said contraction assembly is an elastomeric or rubber bellows extending between said stationary member and movable member and is disposed in sealing relation to each said stationary and movable members.

33. A sealing system as claimed in claim 3 wherein said interconnecting member of said contraction assembly is an elastomeric or rubber bellows extending between said stationary member and movable member and is disposed in sealing relation to each said stationary and movable members.

34. A sealing system as claimed in claim 4 wherein said interconnecting member of said contraction assembly is an elastomeric or rubber bellows extending between said stationary member and movable member and is disposed in sealing relation to each said stationary and movable members.

35. A sealing system as claimed in claim 5 wherein said interconnecting member of said contraction assembly is an elastomeric or rubber bellows extending between said stationary member and movable member and is disposed in sealing relation to each said stationary and movable members.

36. A sealing system as claimed in claim 1 wherein said interconnecting member of said contraction assembly is a metal bellows extending between said stationary member and movable member and is disposed in sealing relation to each said stationary and movable members.

37. A sealing system as claimed in claim 2 wherein said interconnecting member of said contraction assembly is a metal bellows extending between said stationary member and movable member and is disposed in sealing relation to each said stationary and movable members.

38. A sealing system as claimed in claim 3 wherein said interconnecting member of said contraction assembly is a metal bellows extending between said stationary member and movable member and is disposed in sealing relation to each said stationary and movable members.

39. A sealing system as claimed in claim 4 wherein said interconnecting member of said contraction assembly is a metal bellows extending between said stationary member and movable member and is disposed in sealing relation to each said stationary and movable members.

40. A sealing system as claimed in claim 5 wherein said interconnecting member of said contraction assembly is a metal bellows extending between said stationary member and movable member and is disposed in sealing relation to each said stationary and movable members.

41. A sealing system as claimed in claim 1 wherein said slurry pump casing is fixed to a pedestal and said bearing housing is slidable relative to said pedestal toward said slurry pump.

42. A sealing system as claimed in claim 6 wherein said slurry pump casing is fixed to a pedestal and said bearing housing is slidable relative to said pedestal toward said slurry pump.

43. A sealing system as claimed in claim 18 wherein said slurry pump casing is fixed to a pedestal and said bearing housing is slidable relative to said pedestal toward said slurry pump.

44. A sealing system as claimed in claim 26 wherein said slurry pump casing is fixed to a pedestal and said bearing housing is slidable relative to said pedestal toward said slurry pump.

45. A sealing system as claimed in claim 29 wherein said slurry pump casing is fixed to a pedestal and said bearing housing is slidable relative to said pedestal toward said slurry pump.

46. A sealing system as claimed in claim 31 wherein said slurry pump casing is fixed to a pedestal and said bearing housing is slidable relative to said pedestal toward said slurry pump.

47. A sealing system as claimed in claim 34 wherein said slurry pump casing is fixed to a pedestal and said bearing housing is slidable relative to said pedestal toward said slurry pump.

48. A sealing system as claimed in claim 36 wherein said slurry pump casing is fixed to a pedestal and said bearing housing is slidable relative to said pedestal toward said slurry pump.

49. A sealing system as claimed in claim 39 wherein said slurry pump casing is fixed to a pedestal and said bearing housing is slidable relative to said pedestal toward said slurry pump.

50. The sealing system as claimed in claim 3 wherein said seal assembly includes a at least one mating ring, at least one primary ring and at least one biasing element to bias the primary ring towards the mating ring.

51. The sealing system as claimed in claim 50 wherein said biasing element is a spring.

52. The sealing system as claimed in claim 51 wherein said spring is a coil spring.

53. The sealing system as claimed in claim 52 wherein said seal assembly includes a second mating ring, a second primary ring and a second biasing element.

54. The sealing system as claimed in claim 53 wherein said second mating ring, said second primary ring and said second biasing element are located radially of said first mating ring, said first primary ring and said first biasing element.

55. A method providing for adjustment of a pump impeller relative to its casing wherein said pump includes an impeller shaft supported in a bearing housing movable axially toward said impeller casing and wherein said adjustment includes moving said shaft axially by moving said bearing housing relative to said pump casing, the steps comprising:

providing a mechanical seal assembly attached to said shaft and said bearing housing which is axially movable with said shaft and bearing housing;

providing a contraction assembly surrounding said shaft and extending between said pump casing and said bearing housing to accommodate said movement of said bearing housing relative to said impeller casing;

adjusting said clearance by moving said bearing housing and shaft toward said impeller casing;

moving said seal assembly with said shaft and bearing housing; and contracting said contraction assembly on movement of said bearing housing and shaft to accommodate the movement of said bearing housing relative to said pump casing.

56. A method as claimed in claim 55 wherein movement of said bearing housing relative to said pump casing moves said mechanical seal assembly the same axial distance as said movement of said bearing housing is moved relative to said pump casing.

57. A method as claimed in claim 55 wherein said seal assembly includes at least one mechanical seal having at least one seal ring connected to said shaft for rotation and axial movement therewith and a seal ring connected to said movable member for axial movement therewith.

58. A method as claimed in claim 57 wherein said seal assembly includes two seal rings connected to said shaft for rotation and axial movement therewith and said seal assembly includes two seal rings connected to said movable member for axial movement therewith, each one of said rings connected to said shaft being in relatively rotating sealing relation with one of said two rings connected to said movable member.

59. A method as claimed in claim 55 wherein;

said contracting assembly is a telescopic assembly and includes a stationary member secured to said pump casing and surrounding said shaft;

a movable member fixed to said bearing housing for movement with said bearing housing and surrounding said shaft; and an interconnecting member including a tubular extension surrounding said shaft extending from one of said stationary member and movable member having a free end slidable relative to the other of such members, said tubular extension disposed in sealing relation to each said stationary and movable members.

60. A method as claimed in claim 59 wherein at least one gland plate is attached to said bearing housing, said at least one gland plate is annular and surrounds said shaft, and defines a seal assembly chamber surrounding said shaft and said movable member is secured to said at least one gland plate.

61. A method as claimed in claim 60 wherein said seal assembly is disposed in said seal chamber.

62. A method as claimed in claim 61 wherein said seal assembly includes at least one mechanical seal having at least one seal ring connected to said shaft for rotation and axial movement therewith and a seal ring connected to said movable member for axial movement therewith.

63. A method as claimed in claim 62 wherein said seal assembly includes two seal rings connected to said shaft for rotation and axial movement therewith and said seal assembly includes two seal rings connected to said movable member for axial movement therewith, each one of said rings connected to said shaft being in relatively rotating sealing relation with one of said two rings connected to said movable member.

64. A method as claimed in claim 55 wherein said interconnecting member of said contraction assembly is a bellows extending between said stationary member and movable member and is disposed in sealing relation to each said stationary and movable members.

65. A method as claimed in claim 64 wherein at least one gland plate is attached to said bearing housing, said at least one gland plate is annular and surrounds said shaft, and defines a seal assembly chamber surrounding said shaft and said movable member is secured to said at least one gland plate.

66. A method as claimed in claim 65 wherein said seal assembly is disposed in said seal chamber.

67. A method as claimed in claim 66 wherein said seal assembly includes at least one mechanical seal having at least one seal ring connected to said shaft for rotation and axial movement therewith and a seal ring connected to said movable member for axial movement therewith.

68. A method as claimed in claim 67 wherein said seal assembly includes two seal rings connected to said shaft for rotation and axial movement therewith and said seal assembly includes two seal rings connected to said movable member for axial movement therewith, each one of said rings connected to said shaft being in relatively rotating sealing relation with one of said two rings connected to said movable member.

69. A method as claimed in claim 55 wherein said interconnecting member of said contraction assembly is an elastomeric or rubber bellows extending between said stationary member and movable member and is disposed in sealing relation to each said stationary and movable members.

70. A method as claimed in claim 69 wherein at least one gland plate is attached to said bearing housing, said at least one gland plate is annular and surrounds said shaft, and defines a seal assembly chamber surrounding said shaft and said movable member is secured to said at least one gland plate.

71. A method as claimed in claim 70 wherein said seal assembly is disposed in said seal chamber.

72. A method as claimed in claim 71 wherein said seal assembly includes at least one mechanical seal having at least one seal ring connected to said shaft for rotation and axial movement therewith and a seal ring connected to said movable member for axial movement therewith.

73. A method as claimed in claim 72 wherein said seal assembly includes two seal rings connected to said shaft for rotation and axial movement therewith and said seal assembly includes two seal rings connected to said movable member for axial movement therewith, each one of said rings connected to said shaft being in relatively rotating sealing relation with one of said two rings connected to said movable member.

74. A method as claimed in claim 55 wherein said interconnecting member of said contraction assembly is an elastomeric or rubber bellows extending between said stationary member and movable member and is disposed in sealing relation to each said stationary and movable members.

75. A method as claimed in claim 74 wherein at least one gland plate is attached to said bearing housing, said at least one gland plate is annular and surrounds said shaft, and defines a seal assembly chamber surrounding said shaft and said movable member is secured to said at least one gland plate.

76. A method as claimed in claim 75 wherein said seal assembly is disposed in said seal chamber.

77. A method as claimed in claim 76 wherein said seal assembly includes at least one mechanical seal having at least one seal ring connected to said shaft for rotation and axial movement therewith and a seal ring connected to said movable member for axial movement therewith.

78. A method as claimed in claim 77 wherein said seal assembly includes two seal rings connected to said shaft for rotation and axial movement therewith and said seal assembly includes two seal rings connected to said movable member for axial movement therewith, each one of said rings connected to said shaft being in relatively rotating sealing relation with one of said two rings connected to said movable member.

* * * * *